US005078219A

United States Patent [19]

Morrell et al.

[11] Patent Number: 5,078,219

[45] Date of Patent: Jan. 7, 1992

[54] CONCAVE DRAG BIT CUTTER DEVICE AND METHOD

[75] Inventors: Roger J. Morrell, Bloomington; David A. Larson, Minneapolis, both of Minn.

[73] Assignee: The United States of America as represented by the Secretary of the Interior, Washington, D.C.

[21] Appl. No.: 553,467

[22] Filed: Jul. 16, 1990

[51] Int. Cl.[5] ..... E21B 10/46

[52] U.S. Cl. ..... 175/410; 299/86; 299/91

[58] Field of Search ..... 175/57, 410; 299/10, 299/79, 86, 90, 91

[56] References Cited

U.S. PATENT DOCUMENTS 3,856,359 12/1974 Krekeler ..... 299/86
4,593,777 6/1986 Barr ..... 175/410
4,678,237 7/1987 Collin ..... 299/79
4,783,123 11/1988 Ottestad ..... 299/94
4,906,294 3/1990 von Haas et al. ..... 299/79
4,911,254 3/1990 Keith ..... 175/410

*Primary Examiner*—Terry L. Melius
*Attorney, Agent, or Firm*—E. Phillip Koltos

[57] ABSTRACT

A concave drag bit cutter device and cutting method using such a concave cutter bit are provided which provide substantially increased efficiencies over conventional point attack bits. A number of different cutter bit shapes employing a concave cutting face can be used. The cutter bits are intended to replace the conventional point attack cutter bits and can be used in continuous mining machines, saw blades, auger drills, longwall shearers and the like, in cutting and mining operations.

8 Claims, 2 Drawing Sheets

CONCAVE DRAG BIT CUTTER DEVICE AND METHOD

FIELD OF THE INVENTION

The present invention relates to drag bit cutters and more particularly to an improved drag bit and an improved cutting method using the drag bit.

BACKGROUND OF THE INVENTION

Conventional drag bits used in, for example, continuous mining machines, saw blades, auger drills, longwall shearers and the like are basically of a shape wherein only the tip presents an effective cutting edge while the remainder of the cutting face effectively pushes the material out of the path of the bit. Examples of cutting tools of this general type include those disclosed in U.S. Pat. Nos. 2,690,904 (Muschamp et al) and 4,804,231 (Buljan et al). The former patent discloses a cutter pack assembly for reversible chain mining machines which employs conventional straight edge pick points while the latter discloses a point attack style mine and milling tool.

Further patents of interest are because of the shaped of the cutters or cutter members provided include U.S. Pat. Nos. 4,593,777 (Barr), 4,559,753 (Barr), and 4,538,690 (Short, Jr.). Before considering these patents in more detail, the nomenclature used in describing cutters and bits requires some clarification. The Barr and Short, Jr. patents describe a drag bit and associated cutters, with the overall device being referred to as the drag bit. This drag bit is equipped with a series of cutter elements that actually cut the rock and these are referred to as cutting members or simply cutters. This is a common arrangement for rotary drill bits. However, in the field of excavation the nomenclature is somewhat different. More particularly, the overall device which mounts the cutting elements is generally referred to as the cutterhead while the individual cutting elements are referred to as bits. Thus, the individual drag bits of the present application correspond to the cutting members of cutters of the Short, Jr. and Barr patents. Further, the devices disclosed in those patents concern a particular type of cutterhead which is referred to as a drag type drill bit and which is used with a rotary drilling machine to drill relatively small diameter holes, typically up to 24 inches in diameter.

With this background, it is noted that the cutters of the Short, Jr. and Barr patents are broadly relevant to the present invention to the extent that these cutters are concave in shape but are otherwise irrelevant. The cutters of these patents are combined with a thin, hard coating (e.g. PDC) which is said to yield superior wear characteristics over conventional-flat face cutters. In particular, these patents state that the PDC coating maintains a sharp cutting edge even as the edge wears and that the rake angle of the concave shape changes as the edge wears, so that the changing rake angle allegedly provides an optimum match for different types of rocks encountered.

SUMMARY OF THE INVENTION

In accordance with one aspect of the present invention, a method of cutting using a drag bit is provided wherein drag bit having a concave cutting insert or face is employed . It has surprisingly been found that the use of such concave cutting bits results in substantially improved efficiency as compared with conventional drag bits. The improved cutting efficiency is the product of a reduction on both the cutting forces and the thrust forces that must be exerted. It will be appreciated that this is an important advantage in that less horsepower is thus required to cut or mine a given volume of material and such reduced horsepower means lower capital and operating costs. On the other hand, if the input horsepower is held constant, the cutting or mining rate is significantly improved as compared with that provided by drag bits. The invention, as applied to rotating concave bits, provides the additional advantage, over conventional drag bits, of improved life, i.e., increased wear resistance. This improved bit life is obviously very important in that costs can be reduced while maintaining the same basic cutting efficiency over long periods. In fact, it has been estimated that a reduction in cost by factor of 3 or 4 may be possible with the present invention. It is noted that cutters of the Short, Jr. and Barr patents are fixed, i.e., non-rotating, and thus cannot provide this advantage. Moreover, these cutters are not replaceable but rather are brazed in place in a conventional manner.

The concave drag bits of the invention is of the rotating style, and it will be understood that it is used to replace the conventional conical or point attack bit presently being used. As was mentioned above, in addition to cutting efficiency, the rotating type concave provides another important advantage in that, as the bit rotates during the cutting process, the bit wear is spread evenly around the circular cutting edge thereby resulting in reduced bit cost while maintaining cutting efficiency over a longer period.

Generally speaking, the concave drag bit of the invention basically comprises two main parts, the cutting insert and the mounting shank. The cutting insert is rigidly attached to the mounting shank by using mechanical bolts or clamps or by employing standard brazing techniques. The mounting shank is circular in shape and is preferably made of high-strength steel. The shank is equipped with a device for holding the bit in the bit holder. Examples of such devices include, but are not limited to, snap rings, retainer rings, hose clamps and retaining pins.

The round shank of the concave bit is designed to fit into the standard point attack bit holder. However, most point attack bits are mounted at a 45 degree angle to the material being cut and this 45 degree angle is not suitable for the concave bit. The concave bit should be oriented to achieve a rake angle normally between about ±30 degrees. Therefore, on old cutterheads, the bit holders need to be removed and reoriented or a special transition adapter needs to be used to achieve the correct mounting angle. On new cutterheads, the bit holders can be installed initially at the correct mounting angle for the concave bit.

Comparing the invention with the prior art cutter devices used for the same purposes, the concave drag bit of the invention with its concave cutting insert or face creates an effective cutting edge around the entire periphery of the cutting face. In this respect, regardless of what part of the cutting face contacts the material being cut, an "aggressive," highly effective cutting edge is involved. The overall result is that the concave bit cuts through the material instead of prying or pushing the material out of the way. As noted above, with conventional drag bits, only the tip presents an effective cutting edge, and the remainder of the cutting face essentially pushes the material out of the path.

It is also noted that the concave bits of the invention are especially useful where the material to be cut is confined. This normally occurs at the gage or edge of a hole or opening and also when kerfs are being cut. A conventional bit wastes energy n these situations due to the tendency thereof to produce side chipping, which is prevented by the sides of the cut. Concave bits, therefore, make superior gage cutters on all types of rotary cutterheads, rotary drills, trenching machines, saws, and auger drills.

Other features and advantages of the invention will be set forth in, or apparent from, the following detailed description of preferred embodiments of the invention.

DESCRIPTION OF THE PREFERRED EMBODIMENTS

Figure 1:
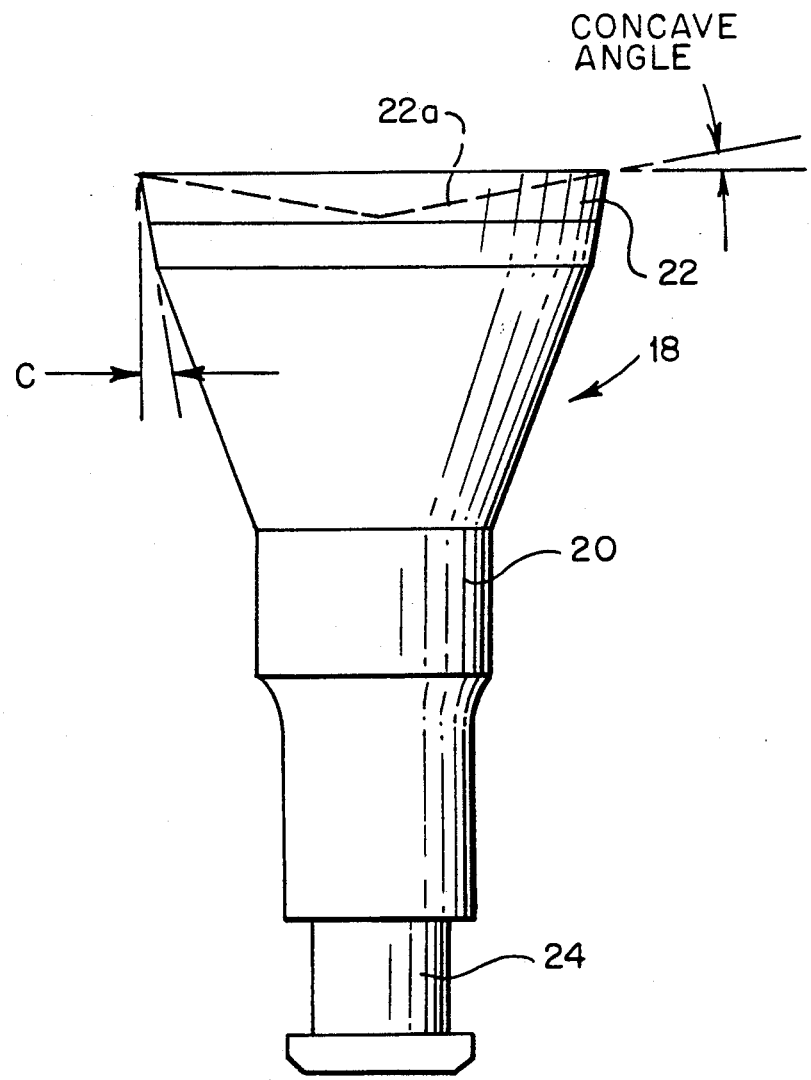
FIG. 1 is a side (front) elevational view of a rotating style concave cutter bit constructed in accordance with a further exemplary, preferred embodiment of the invention.
Figure 2:
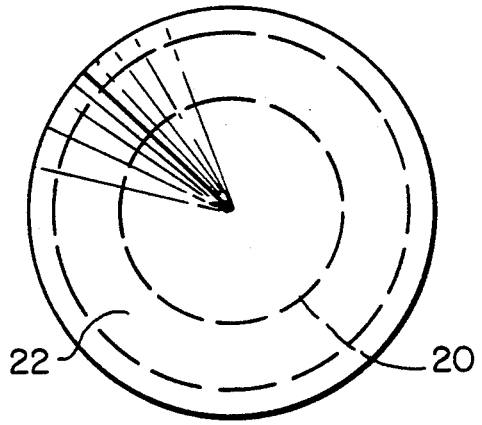
FIG. 2 is a top plan view of the cutter bit of FIG. 6.

Referring to FIGS. 1 and 2, the basic embodiment of the cutter bit assembly of the invention is shown which is of the rotating type or style. The cutter bit assembly of FIGS. 1 and 2, which is generally denoted 18, includes a concave bit insert 22 mounted in a mounting shank 20. Although the style of shank 20 forms no part of the invention, the shank as shown. FIGS. 1 and 2 circular (cylindrical) in geometry and include a space 24 for a conventional retainer mechanism (not shown). The clearance angle is indicated at C.

Figure 3:
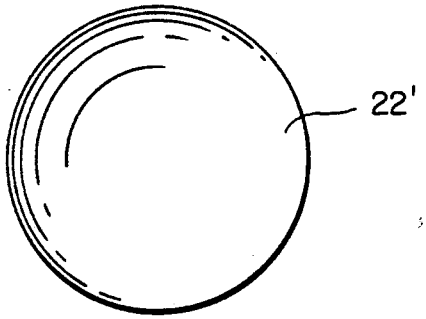
FIGS. 3(*a*) and 3(*b*) are a top plan view and a side elevational view, respectively, of a concave cutter bit insert of the style of FIGS. 1 and 2 in accordance with a further preferred embodiment of the invention.
Figure 3:
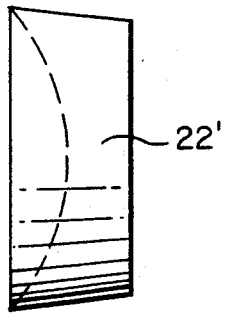
Figure 4:
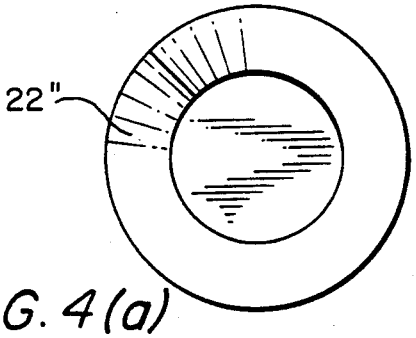
FIGS. 4(*a*) and 4(*b*) are a top plan view and a side elevational view, respectively, of a cutter bit insert of the style of FIGS. 1 and 2 in accordance with yet another preferred embodiment of the invention.
Figure 4:
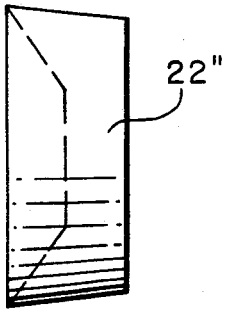

Concave insert 22 is mounted, in a conventional manner, in mounting shank 20 and in the embodiment of FIGS. 1 and 2, includes a concave constant angle face 22*a*, i.e., a face which slopes inwardly from the sides at a constant angle to a central bottom or base point. Again, other concave shapes or geometries can be used in forming the insert face and two further examples are illustrated in FIGS. 3 (*a*) and 3 (*b*), and FIGS. 4 (*a*) and 4 (*b*), respectively. In the, former example, the cutter bit insert, which is denoted 22', has a curved face while in the latter, the insert, which is denoted 22'', has a "combination" face including slanting sides and flat base. It will be appreciated that basically any shape can be combined with any face and that for example, a curved face or a constant angle face can be used in the embodiment of FIG. 1.

Figure 5:
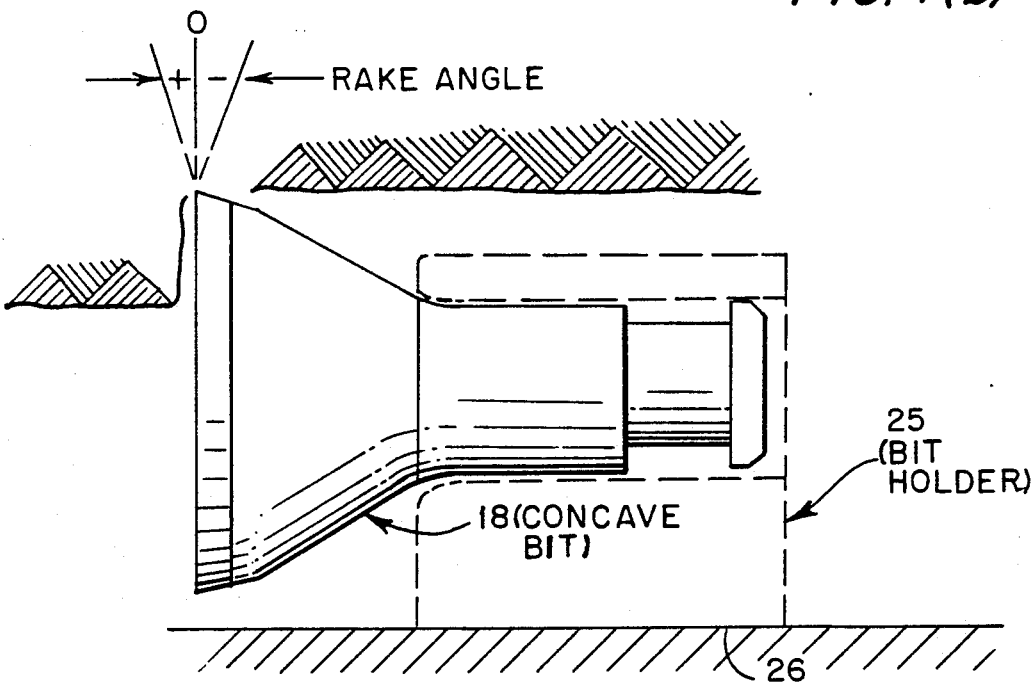
FIG. 5 is a side elevation view which shows the preferred orientation of the rotating style concave bit relative to the cutterhead, the bit holder, and the material being cut.

Referring to FIG. 5 an operating configuration is shown for the rotating bit 18. As illustrated, the shaft 20 of the concave bit 18 is inserted into the bit holder 25 and the bit holder 25 is constructed to make the transitions between the bit 18 and the cutterhead indicated at 26.

It is noted that in actual kerfing tests with 1-in.-wide cutter-type drag bits in Indiana limestone, the concave cutter bits of the invention required approximately 30 percent less cutting force, approximately 65 percent less normal force, and were approximately 30 percent more energy efficient than conventional radial cutter bits. During steady state cutting where successive layers of material are removed, the concave bits of the invention required approximately 15 and 75 percent less cutting force, approximately 30 and 95 percent less normal force, and were approximately 15 and 75 percent more energy efficient than conventional radial cutter bits and point attack bits respectively. It will, of course, be understood that the actual improvement in cutting forces and energy efficiency experienced with concave bits will depend upon the type of material being cut, the geometry of the bits, and the geometry of the cut (i.e. confined versus unconfined, deep versus shallow, and so on).

The cutting insert 22 is preferably made from tungsten carbide, special tool steel, diamond coated tungsten carbide, ceramic, or other suitable cutting materials. The geometry of the concave rotating face can be of the illustrated shapes, i.e., the shapes include but are not limited to, constant angle face, curved face, and combination face. The rake angle, side clearance angle, thickness, and diameter or width of the insert are all variable in design. The actual concave angle, as shown, e.g., in FIG. 1, may vary from 0 degrees to 45 degrees or more, with the 0 degree concave angle being, of course, the lower limit. The rake angle as shown in FIG. 5 may vary from −30 degrees to +30 degrees or more.

The cutting insert is normally attached to the mounting shank by brazing, as noted above, when a tungsten carbide cutting insert is used. For other insert materials, other methods of attachment referred to above, such as bolts or clamps could also be used.

Inserts can be made as a single solid piece or can be constructed of multiple segments which fit together to form a complete insert. Inserts can also be formed as a ring to form only the periphery of the cutting edge. Segmented insert designs reduce brazing stresses while ring designs reduce the amount of expensive insert material required.

Concave bits will normally be between ½-in. and 6-in. in diameter and from 1-in. to 8-in. long and can be made in any style or size to fit any mining, cutting, or excavating machine.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A cutter bit assembly for use in a non-percussive excavation machine, said assembly being rotated during a cutting operation and comprising a replaceable cutter insert and a circular shank in which said insert is mounted, the improvement wherein said cutter insert comprises a cutter bit which, in use, extends generally transversely to a wall being cut and which rotates to provide cutting of the wall, said cutter bit comprising a continuous leading face portion having central concavity therein and defining with a circular edge of said cutter bit a concave cutting surface.

2. A cutter bit assembly as claimed in claim 1 wherein said cutter insert comprises a constant angle face.

3. A cutter bit assembly as claimed in claim 1 wherein said cutter insert comprises a curved face.

4. A cutter bit assembly as claimed in claim 1 wherein said cutter insert comprises a combination face.

5. In a non-percussive excavation machine, a cutterhead assembly comprising a cutterhead and a plurality of bit holders mounted on said cutterhead and a plurality of bit assemblies each received in a respective one of said bit holders, each said bit assembly comprising a replaceable cutter insert and a circular cutter shank in which said insert is mounted, the improvement wherein said cutter insert comprises a cutter bit which, in use, extends generally transversely to a wall being cut and which rotates to provide cutting of the wall, said cutter bit comprising a continuous leading face portion having a central concavity therein and defining with a circular edge of said cutter bit a concave cutting surface.

6. A cutter head arrangement as claimed in claim 5 wherein said cutter insert comprises a constant angle face.

7. A cutter head arrangement as claimed in claim 5 wherein said cutter insert comprises a curved face.

8. A cutter head arrangement as claimed in claim 5 wherein said cutter insert comprises a combination face.

* * * * *